United States Patent [19]

Fonas

[11] Patent Number: 4,712,726

[45] Date of Patent: Dec. 15, 1987

[54] SIMULATED GIFT WRAP BOX

[76] Inventor: Kenneth Fonas, 814 Pittsburgh St., North Versailles, Pa. 15137

[21] Appl. No.: 911,253

[22] Filed: Sep. 24, 1986

Related U.S. Application Data

[63] Continuation-in-part of Ser. No. 732,729, May 10, 1985, abandoned.

[51] Int. Cl.[4] ..... B65D 1/00

[52] U.S. Cl. ..... 229/8; 229/145; 229/127; 229/129; 229/155

[58] Field of Search ..... 229/87 R, 6 R, 45 R, 229/8, 23 R, 43, 44 R, 127, 139, 155, 172, 175, 176, 184, 186, 193, 16 R, 126, 100; D9/430, 431, 432

[56] References Cited

U.S. PATENT DOCUMENTS

| | | | |
|---|---|---|---|
| 642,183 | 1/1900 | Webb | 229/165 |
| 665,556 | 1/1901 | Webb | 229/45 R |
| 1,616,014 | 2/1927 | Walter . | |
| 1,894,226 | 1/1933 | Ross . | |
| 2,319,919 | 5/1943 | Clark | 206/44 |
| 2,793,801 | 5/1957 | Papadopoulous | 229/129 |
| 2,829,817 | 4/1958 | Halpern | 229/129 |
| 2,833,074 | 5/1958 | Jannes | 229/8 |
| 2,992,764 | 7/1961 | Goding | 229/8 |
| 3,343,750 | 9/1967 | Desmond et al. | 229/87 |
| 3,434,645 | 3/1969 | Prisco | 229/8 |
| 3,567,106 | 3/1971 | Anderson | 229/186 |
| 3,581,975 | 6/1971 | Riccio | 229/33 |
| 4,148,429 | 4/1979 | Burr et al. | 229/186 |

FOREIGN PATENT DOCUMENTS

| | | | |
|---|---|---|---|
| 0455965 | 4/1949 | Canada | 229/45 R |
| 1267978 | 6/1961 | France | 229/139 |
| 1001280 | 8/1965 | United Kingdom | 229/8 |

*Primary Examiner*—Willis Little

*Attorney, Agent, or Firm*—Buell, Ziesenheim, Beck & Alstadt

[57] ABSTRACT

A gift-wrap box having a body member and a cover member which may be hinged thereto is folded from a blank of paperboard so that when the box is closed the box ends give the appearance of being wrapped with a separate piece of wrapping paper. If the box has square ends the box ends expose a pair of isosceles triangles aligned at their apexes. If the box has rectangular ends the box ends expose a pair of isosceles triangles or trapezoids which overlap, either completely or partially. The exterior surface of the blank may be colored or decorated to resemble gift wrapping paper.

17 Claims, 23 Drawing Figures

SIMULATED GIFT WRAP BOX

This application is a continuation-in-part of my application, Ser. No. 732,729, filed May 10, 1985, now abandoned.

This invention relates to gift boxes or cartons. It is more particularly concerned with gift boxes that are formed from a sheet of paperboard or the like but which when set up have the appearance of a gift-wrapped box.

BACKGROUND OF THE INVENTION

Various attempts have been made to devise folding boxes which when set up have the appearance of hand-wrapped boxes or packages. Hereinafter I refer to such cartons or boxes as gift wrap boxes. Folding boxes, including the above-mentioned gift boxes, are generally die-cut from a sheet of paperboard or the like as flat blanks. Their shapes are maintained after they are properly folded by glueing or by interlocking tabs or tabs in slots. The great majority of such gift boxes are formed with a separate sheet of decorative wrapping paper attached to the flat box sheet at various locations so that when the box blanks are folded into shape the wrapping paper covers the box in a manner similar to that of a hand-wrapped package. To obtain the desired effect the box blanks and the wrapping sheet are generally not coterminous. Examples of such gift wrap boxes are disclosed in U.S. Pat. Nos. 3,257,068 of June 21, 1966 to M. M. Wright, 3,343,750 of Sept. 26, 1960 to J. D. Desmond, et al., 3,394,867 of July 30, 1968 to W. D. Gregg and 3,951,330 of Apr. 20, 1976 to John D. Desmond.

A gift wrap box not requiring a separate sheet of wrapping paper but having the wrapper design printed on the box would be less expensive than those of the above listed patents and easier to fold on automatic folding machines. Very little appears to have been done in this field. One such carton is disclosed in U.S. Pat. No. 3,942,711 of Mar. 9, 1976 to John D. Desmond, et al. It is a tubular carton opening on an end such as are generally used for bottles of liquor and the like.

SUMMARY OF INVENTION

The gift wrap box of my invention is made from a blank die-cut in the usual manner from a sheet of paperboard or the like, one side of which carries on ornamental design or color printed or otherwise applied to the unitary sheet. The term "otherwise applied" is intended to include a laminated sheet, whether an outer lamination carries an ornamental design or color applied before or after the laminating operation. In either case the design or color need not extend beyond the blank, and may be omitted from those areas which are not visible after the box is set up. The box folded from that blank has a body portion and a cover portion, the body portion having a bottom panel, two opposite sides and two opposite ends; the cover portion having a top, one or two sides, depending on whether it is a one-piece or a two-piece box, and two opposite ends. The body and cover portions of one-piece boxes are hinged between a side of the body portion and the top of the cover portion. The ends of the cover and body portions of both types of boxes are formed from extensions of the sides and the top and bottom, respectively, all of which extensions are separated from the adjoining extensions.

In one embodiment of my invention the outer corners of the top and bottom panel extensions are folded inwardly into isosceles triangles on diagonals from their inner corners to the mid-points of their outer edges. The side extensions of the body portion are folded toward each other and are preferably made long enough to overlap along a vertical line mid-way between the sides. The bottom panel extension triangles are folded inwardly against the overlapped side extensions. The cover portion is folded in the same way except that the extensions of its side panel or panels extend only to the vertical lines above mentioned. The top panel extension triangles are folded against those side panel extensions. When the cover portion is closed against the body portion the corners of the cover side panel extensions are inserted between the body portion triangles and their underlying side extensions, thus aligning the apexes of the cover and body triangles to give the appearance of a hand-wrapped box.

In another embodiment of my box the free corners of the bottom panel extensions are folded along diagonals into isosceles trapezoids. The body portion side panel extensions may be cut with a turnover flap on their upper edges and the upper edges of the body trapezoids are turned over with those flaps, thus forming a stiffener in each edge. The top panel extensions of the cover portion likewise fold into trapezoids. The side panel extensions of the cover are cut with slots from their outside corners paralleling the diagonal sides of the cover trapezoids but extending only about halfway along those diagonals. When the cover portion is closed on the body portion the corners of those extensions form tuck tabs which fit between the bottom panel trapezoids and the extensions of the bottom side panels behind them. When the box is assembled, the cover and body trapezoids may meet or overlap, thus giving the box ends the appearance of a hand-wrapped carton.

In both embodiments of my article above summarized the folded triangles or trapezoids of the cover and body ends are preferably glued to their underlying elements.

DESCRIPTION OF PREFERRED EMBODIMENTS OF ONE-PIECE GIFT WRAP BOX

Figure 1:
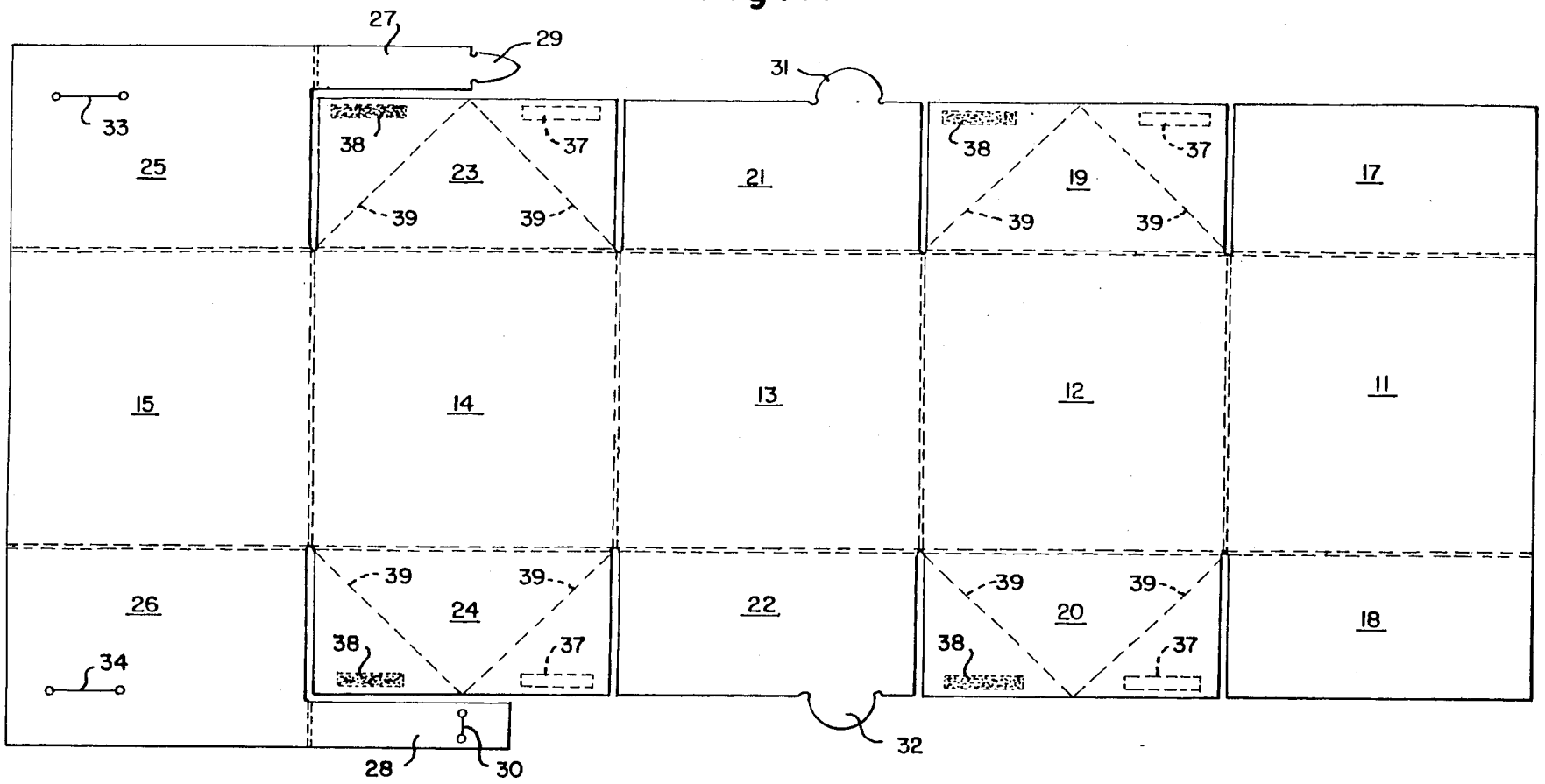
FIG. 1 is a plan of a paperboard blank which when folded forms a one-piece gift wrap box of my invention.

The blank of FIG. 1 comprises a cover portion side panel 11, a cover portion top panel 12, a body portion side panel 13, a body portion bottom panel 14 and a body portion side panel 15. The cover and body portions are hinged at the common edge of panels 12 and 13. Panels 11, 12, 13 and 14 have end extensions 17, 19, 21 and 23 respectively on one side of the blank and end extensions 18, 20, 22 and 24 respectively on the other side of the blank, all those extensions having a dimension crossways of the blank half of that of their panels 11, 12, 13 and 14. Panel 15 has end extensions 25 and 26 respectively, each having a dimension crossways of the blank greater than half of that panel 15. The extensions of each panel are separated from their adjoining extensions, as may be seen from the figures. Panel extensions 25 and 26 have tongues 27 and 28 respectively on their edges adjoining panel extensions 23 and 24 respectively, extending more than halfway across said panel extensions 23 and 24. Tongue 27 has a reduced width tip 29 and tongue 28 has a transverse slot 30 positioned halfway across panel 24, which slot accepts tip 29 when my box is folded, constituting one form of stiffener, as will be described hereinafter. The extensions 21 and 22 of panel 13 at each end have tabs 31 and 32 respectively projecting from their outer edges and the extensions 25 and 26 of panel 15 each have slots 33 and 34 respectively positioned to accept tabs 31 and 32 respectively when my box is folded, as will be described hereinafter.

Areas 37 in panel extensions 19, 20, 23 and 24 are areas where glue is applied to the faces of the extensions unexposed in FIG. 1 and areas 38 in those panel extensions are areas where glue is applied to the faces of the extensions exposed in FIG. 1 before my box is folded and assembled. All the dividing lines between panels, and between panels and extensions thereof are creased.

Figure 2:
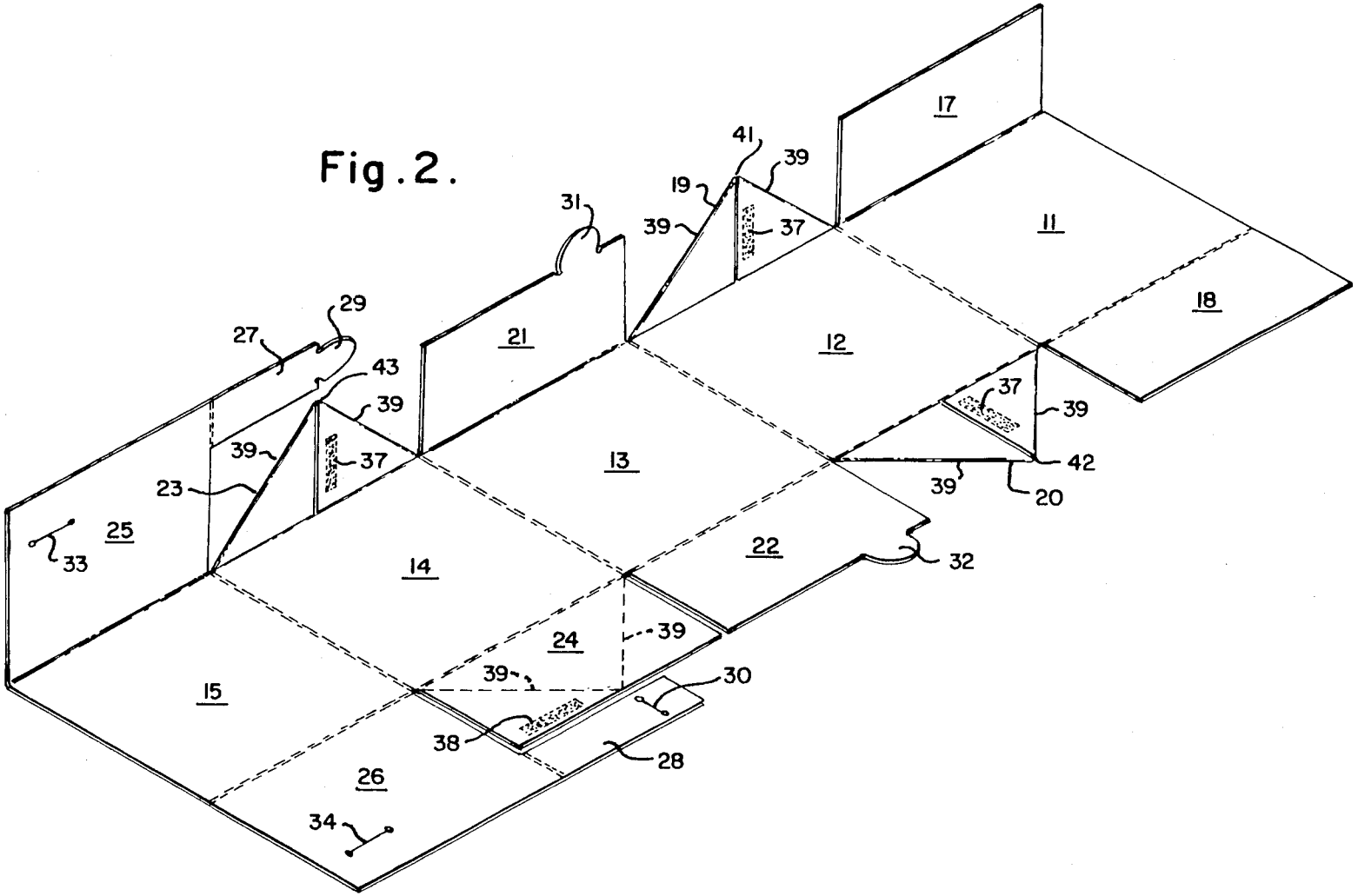
FIGS. 2, 3, 4 and 5 are isometrics of the blank of FIG. 1 after its first, second, third and fourth stages of folding respectively.

In FIG. 2 all the odd numbered panel extensions have been folded 90 degrees upwardly around the creased line common to them. The corners of panel extensions 19 and 23 have been folded inwardly 180 degrees about their respective creased diagonal lines 39, converting those panel extensions into isosceles triangles with apexes 41 and 43 respectively. Panel extension 20 has been folded in the same way, producing apex 42 thereon.

Figure 3:
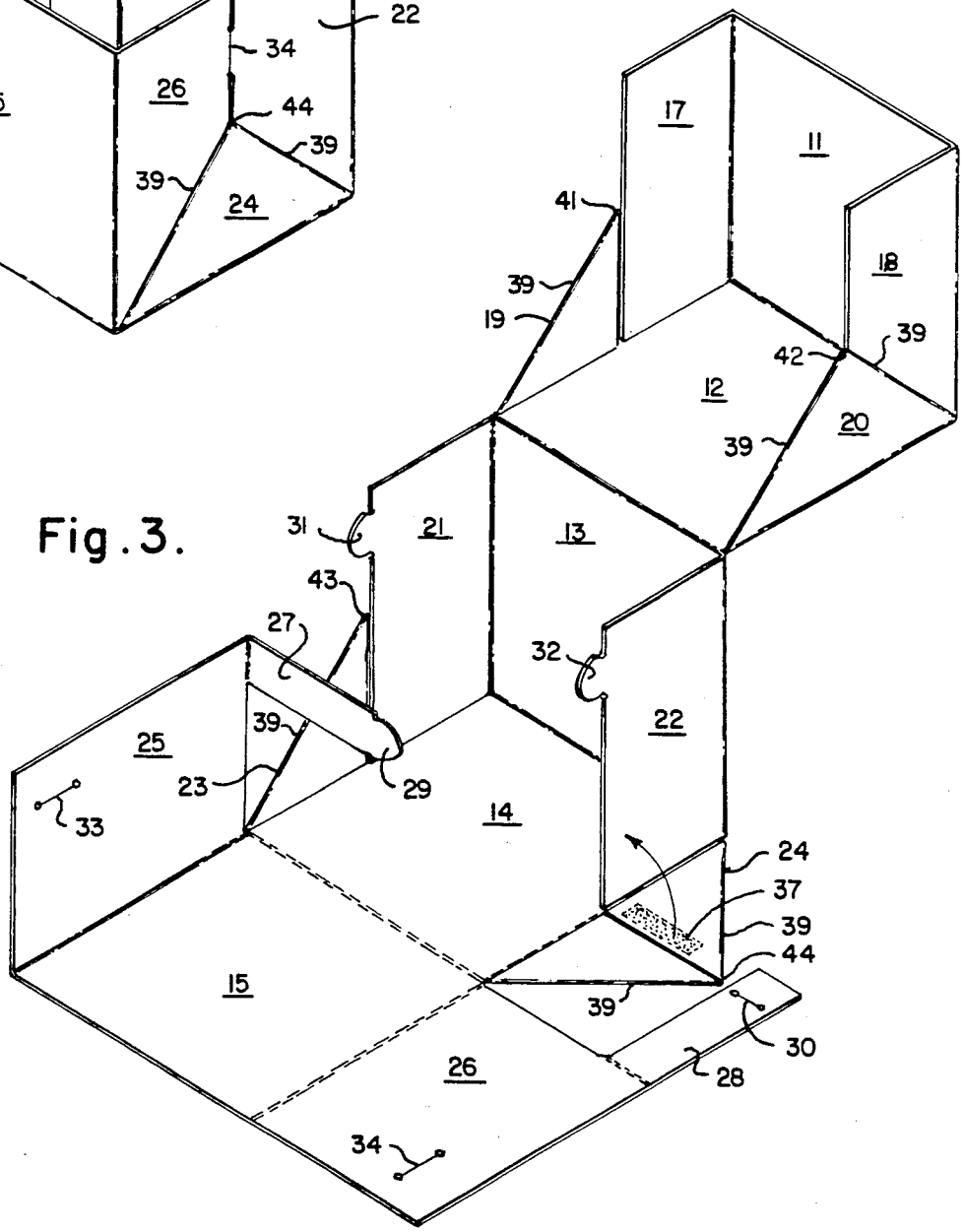

In FIG. 3 the outer corners of panel extensions 24 have been folded inwardly 180 degrees about their respective creased diagonal lines 39, converting panel extension 24 into an isosceles triangle with apex 44. Body side panel 13 has been folded upwardly 90 degrees about its edge common to bottom panel 14. Side extension 22 of panel 13 has also been folded 90 degrees inwardly about its edge common to panel 13 bringing it upright and parallel to side extension 21. Side panel extension 18 has been folded upright normal to side panel 11 and top panel extensions 19 and 20, now triangles, are folded upright against side panel extensions 17 and 18 respectively. The apexes 41 and 42 of those triangles lie on the edges of panel extensions 17 and 18 respectively. In the figure top panel 12 has been folded away from the uncompleted body portion of my box to show the completed cover portion comprising panels 11, 12, 17, 18, 19 and 20.

Figure 4:
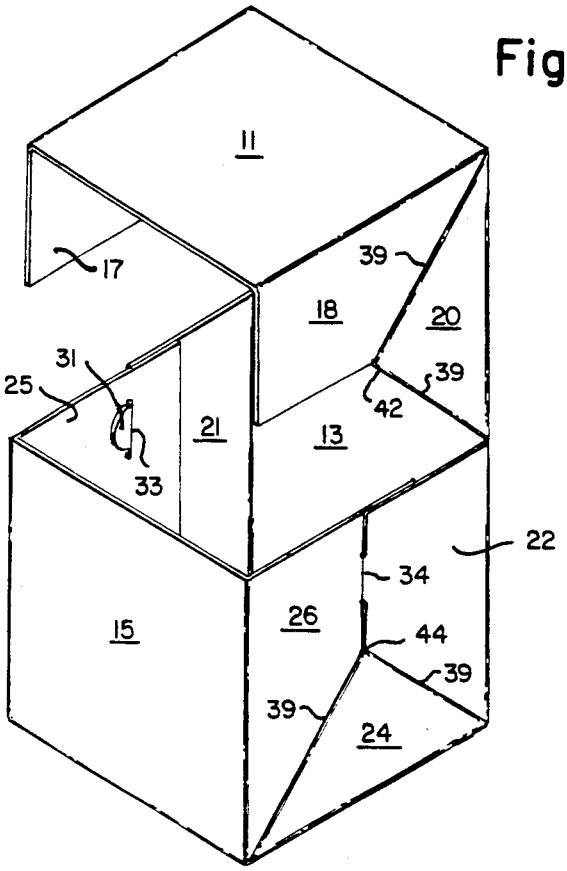

The completed box with its cover partially raised is shown in FIG. 4. Panel extensions 24 and 26 have been folded upright and side panel 15 has been folded upright around its edge common to bottom panel 14. That folding permits tab 31 to enter slot 33 in panel extension 25 and also permits tab 32 to enter slot 34 in panel extension 26. The apex 44 of triangle 24 lies on the body portion between panel extensions 22 and 26, which is also the preferred location of the slot 34.

Figure 5:
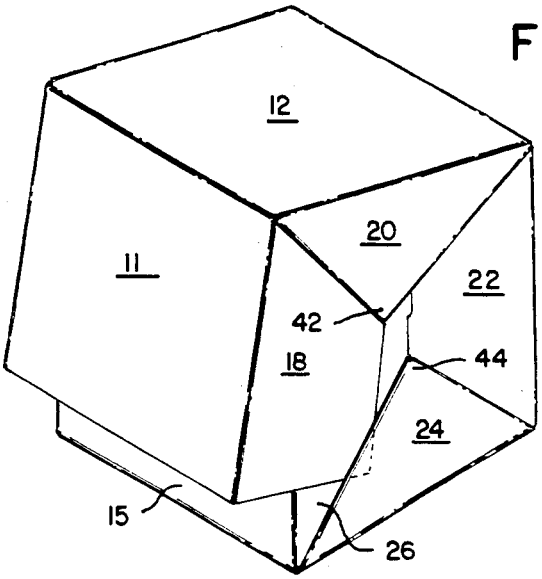
Figure 6:
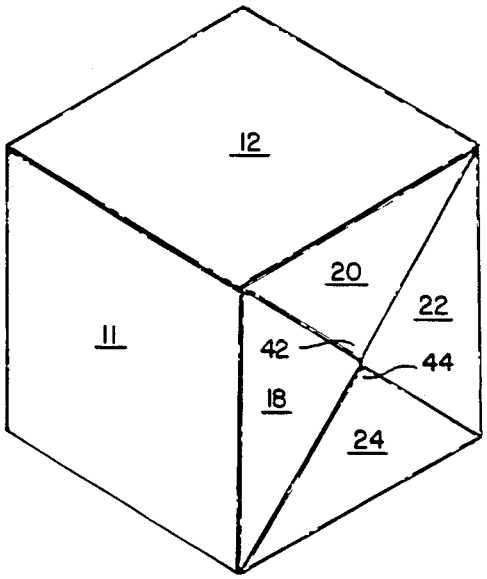
FIG. 6 is an isometric of the blank of FIG. 1 folded into a box of my invention.

The box with its cover nearly closed is shown in FIG. 5. As its cover is brought down, the outside corner of side panel 18 is inserted between triangular panel 24 and side panel extension 26. The corner of side panel extension 17 likewise is inserted between triangular panel 23 and side panel extension 25 on the other side of FIG. 5, not shown. FIG. 6 illustrates the completely closed box. The apexes 42 and 44 of triangles 20 and 24 meet, giving the ends of the box the appearance of a hand wrapped package.

Figure 7:
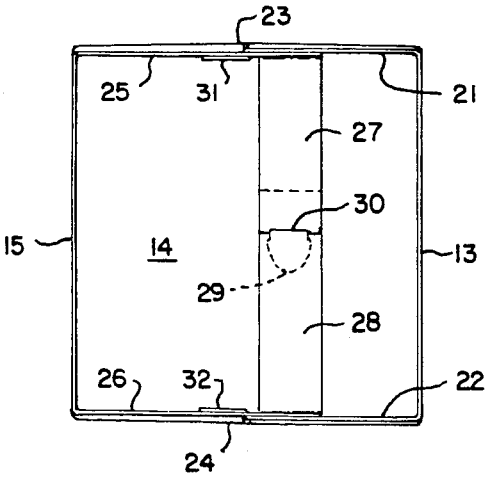
FIG. 7 is an inside view of the bottom of the body portion of the box of FIG. 6 showing one form of stiffener.

FIG. 7 illustrates the stiffeners formed against the bottom 14 of my box by tongues 27 and 28. The tip 29 of tongue 27 enters the slot 30 of tongue 28. The purpose of the stiffener is to brace the two composite end walls of the body portion. Other stiffening arrangements may be employed.

Figure 8:
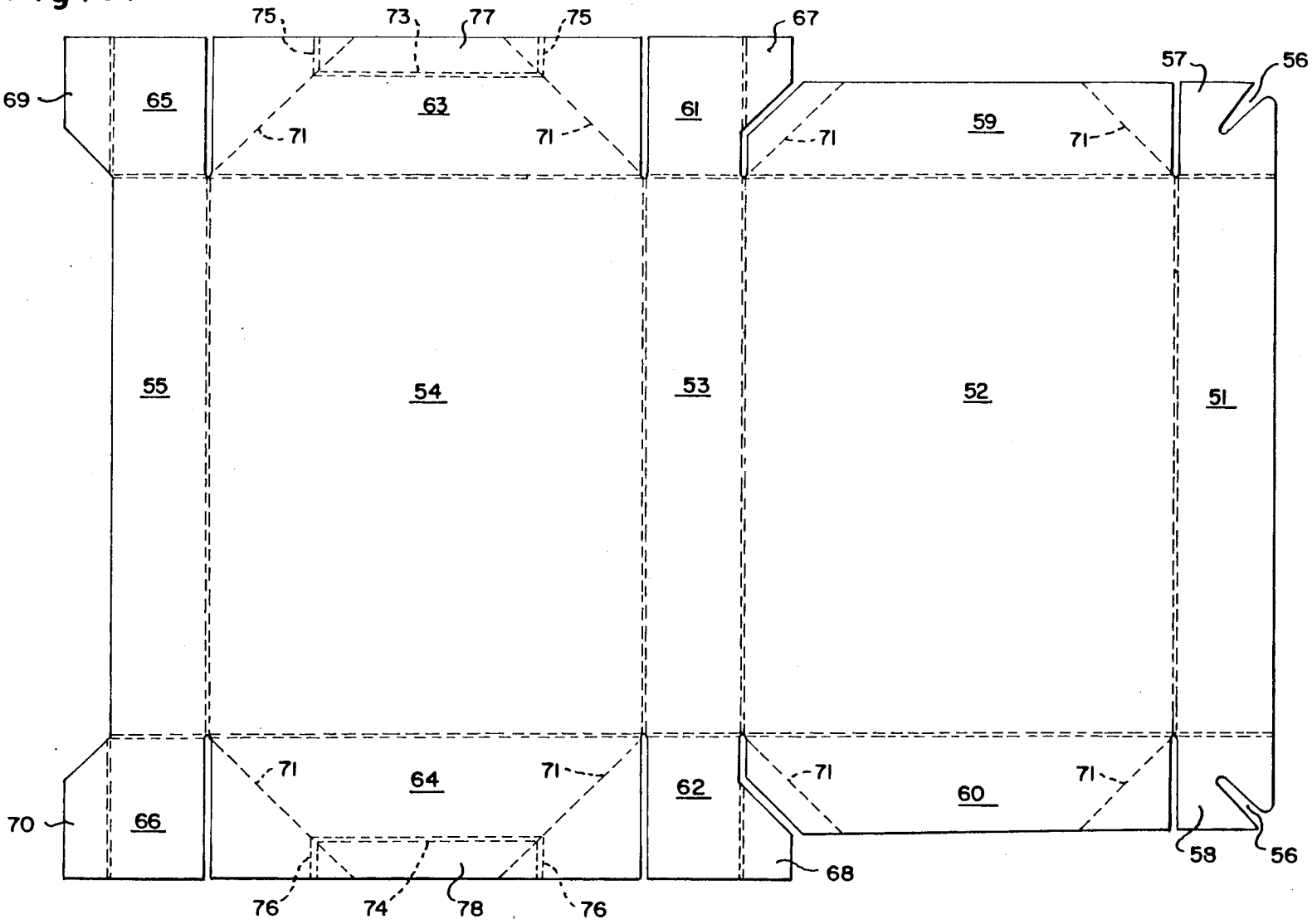
FIG. 8 is a plan of a paperboard blank which when folded forms a second embodiment of the one-piece gift box of my invention, showing a form of stiffener.

A second embodiment of the one-piece box of my invention is suitable for relatively flat boxes. FIG. 8 shows the box blank comprising cover side panel 51, top panel 52, body side panel 53, bottom panel 54 and body side panel 55. Panel 51 has extensions 57 and 58 respectively at each end; each extension having a diagonal slot 56 running from its outside corner about halfway along its diagonal. Panel 52 has end extensions 59 and 60. Panel 53 has end extensions 61 and 62 formed with tabs 67 and 68 respectively on their side edges. The adjoining corners of extensions 59 and 60 are cut away diagonally to accommodate those tabs. Bottom panel 54 has end extensions 63 and 64 respectively and body side panel 55 has end extensions 65 and 66 with tabs 69 and 70 corresponding to extensions 61 and 62 previously described. Extensions 61, 62, 63, 64, 65 and 66 are of the same length and extend beyond extensions 57, 58, 59 and 60, which are all of the same length, to provide stock for edge stiffeners, as will be described. All the end extensions above-described are separated from each other, as is seen in the figure. Cover and body portions are hinged along the edge common to panels 52 and 53. Extensions 59, 60, 63 and 64 are creased diagonally along lines 71 from their inside corners. Extensions 63 and 64 are creased parallel to their bottom panel boundaries on lines 73 and 74 respectively, spaced from the adjoining edges of bottom panel 54 at a distance equal to that of the outer edge of extension panels 59 and 60 from the adjoining edges of top panel 52, plus allowance for folding. Creased lines 73 and 74 are the same length except for the folding allowance as the outer edges of extension panels 59 and 60 between their scored diagonal lines 71 and are bounded at each end by scored diagonal lines 71 previously mentioned. Lines 75 are creased normal to the outer edge of extension panel 63 from the ends of creased line 73, and lines 76 are likewise creased normal to the outer edge of extension panel 64 from the ends of creased line 74.

Figure 9:
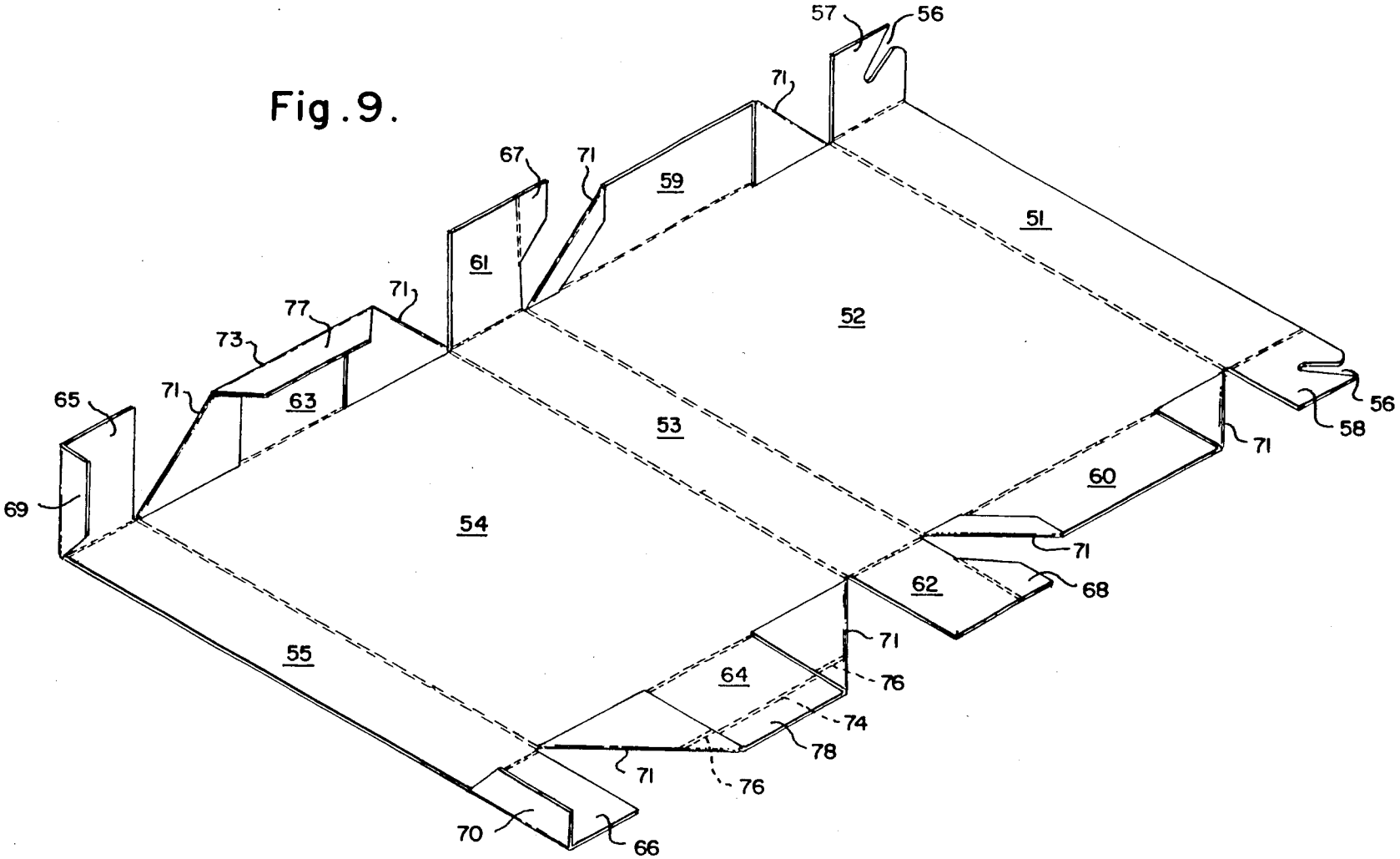
FIGS. 9, 10 and 11 are isometrics of the blank of FIG. 8 in its successive stages of folding.

The first step in erecting my box from the blank of FIG. 8 is shown in FIG. 9. The corners of extension panels 59, 60, 63 and 64 are folded 180 degrees inwardly along creased diagonal lines 71. That folding of panels 63 and 64 aligns creased lines 75 with creased line 73 and creased lines 76 with creased line 74 so as to form flaps 77 and 78 respectively extending from creased lines 73 and 74. Panel extensions 57, 59, 61, 63 and 65 are folded 90 degrees inwardly about their common boundary with panels 51, 52, 53, 54 and 55 respectively. Tabs 69 and 70 are folded inwardly 90 degrees about their respective boundaries with panel extensions 65 and 66. Flap 77 is folded 90 degrees inwardly about creased line 73.

Figure 10:
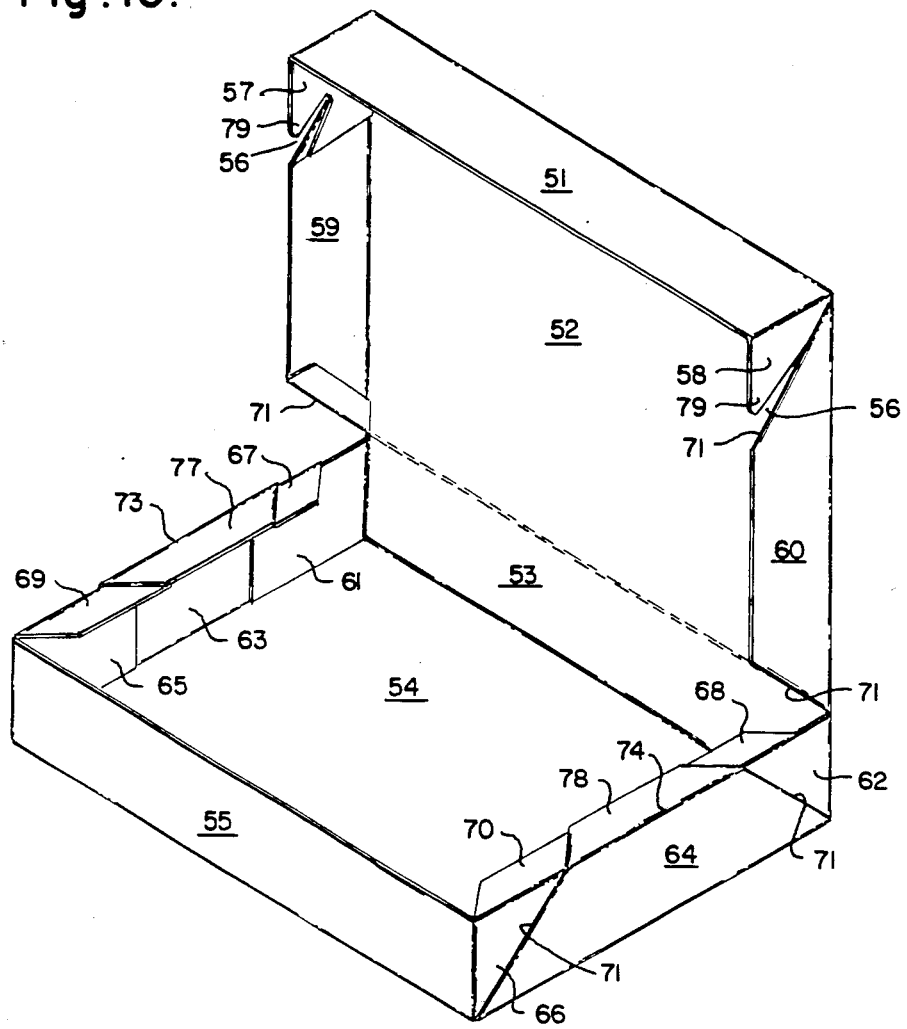

The next step in erecting the box is shown in FIG. 10. Panel extensions 58, 60, 62, 64 and 66 are folded upwardly 90 degrees. Cover side panel 51 together with extensions 57 and 58 is folded upwardly along its edge common to top panel 52. Body side panel 53 is folded upwardly 90 degrees along its edge common to bottom panel 54, bringing panels 51 and 52 and their extensions with it. Flap 78 is folded inwardly 90 degrees around line 74. Extensions 61 and 62 of side panel 53 are folded inside panels 63 and 64 respectively and their tabs 67 and 68 are folded 90 degrees inwardly beneath flaps 77 and 78 respectively. Body side panel 55 is folded 90 degrees upwardly about its edge common to panel 54 and its extensions 65 and 66 are likewise folded inside panels 63 and 64 respectively and their tabs 69 and 70 are folded inwardly beneath tabs 77 and 78. In this way an open box is formed.

Figure 11:
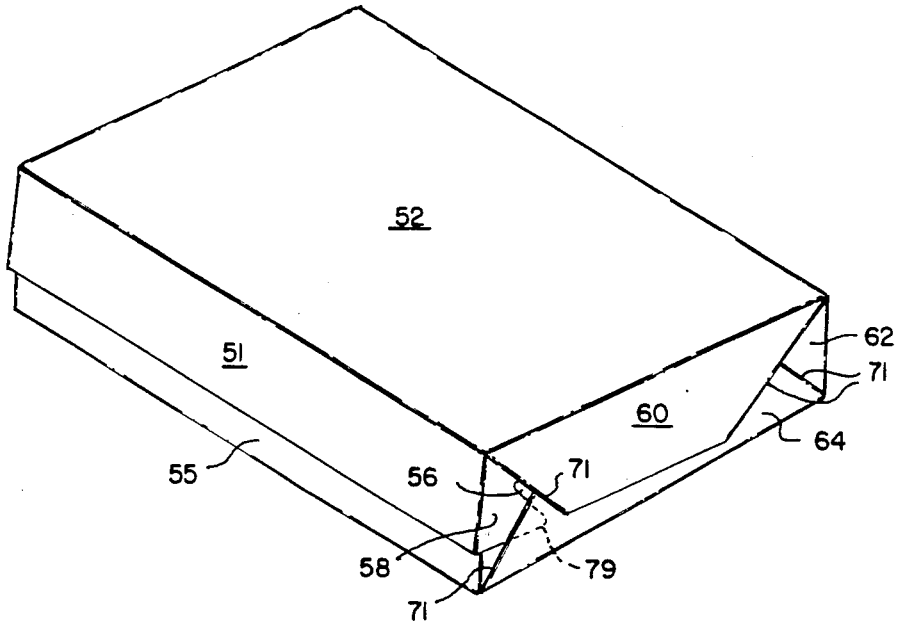
Figure 12:
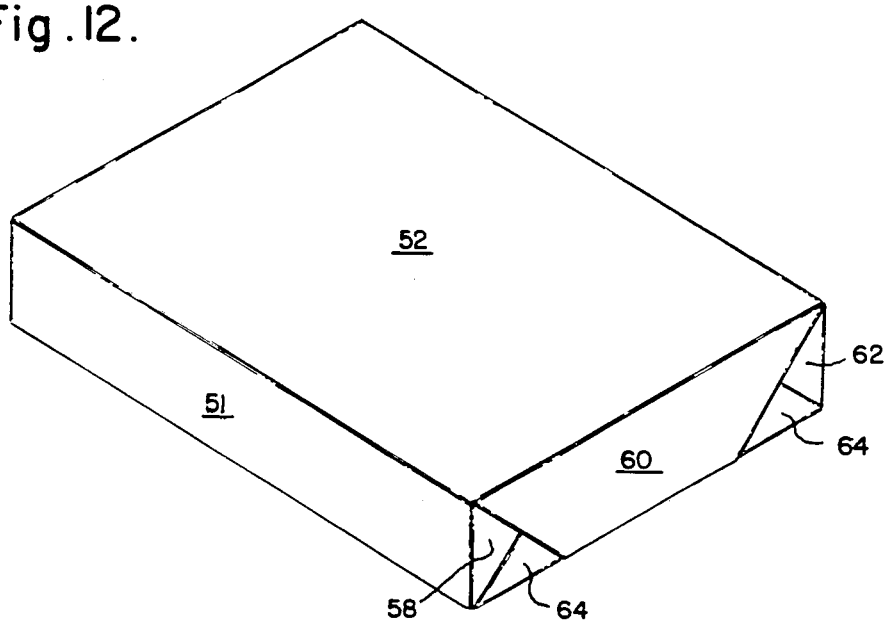
FIG. 12 is an isometric of the blank of FIG. 9 completely folded into a one-piece gift box of my invention.

My box so formed is closed as shown in FIGS. 11 and 12 by folding top panel 52 90 degrees inwardly about its edge common to side panel 53. Top panel extensions 59 and 60, now folded into isosceles trapezoids, come down outside bottom panel extensions 63 and 64 respectively. Panel extensions 57 and 58 are slotted as mentioned so as to form tuck tabs 79. Slots 56 are co-extensive throughout their lengths with the diagonals 71 of adjoining end extensions 59 and 60 when the latter are folded as shown in FIG. 10, and tuck tabs 79 are inserted under the trapezoidal bottom panel extensions 63 and 64 but over body side panel folded extensions 65 and 66 respectively, thus locking the box in the configuration shown in FIG. 12. The overlapping trapezoidal end extensions 60 and 64 on the end shown and 59 and 63 on the other end not shown give my box the appearance of a hand-wrapped package.

DESCRIPTION OF PREFERRED EMBODIMENTS OF TWO-PIECE GIFT WRAP BOX

Figure 13:
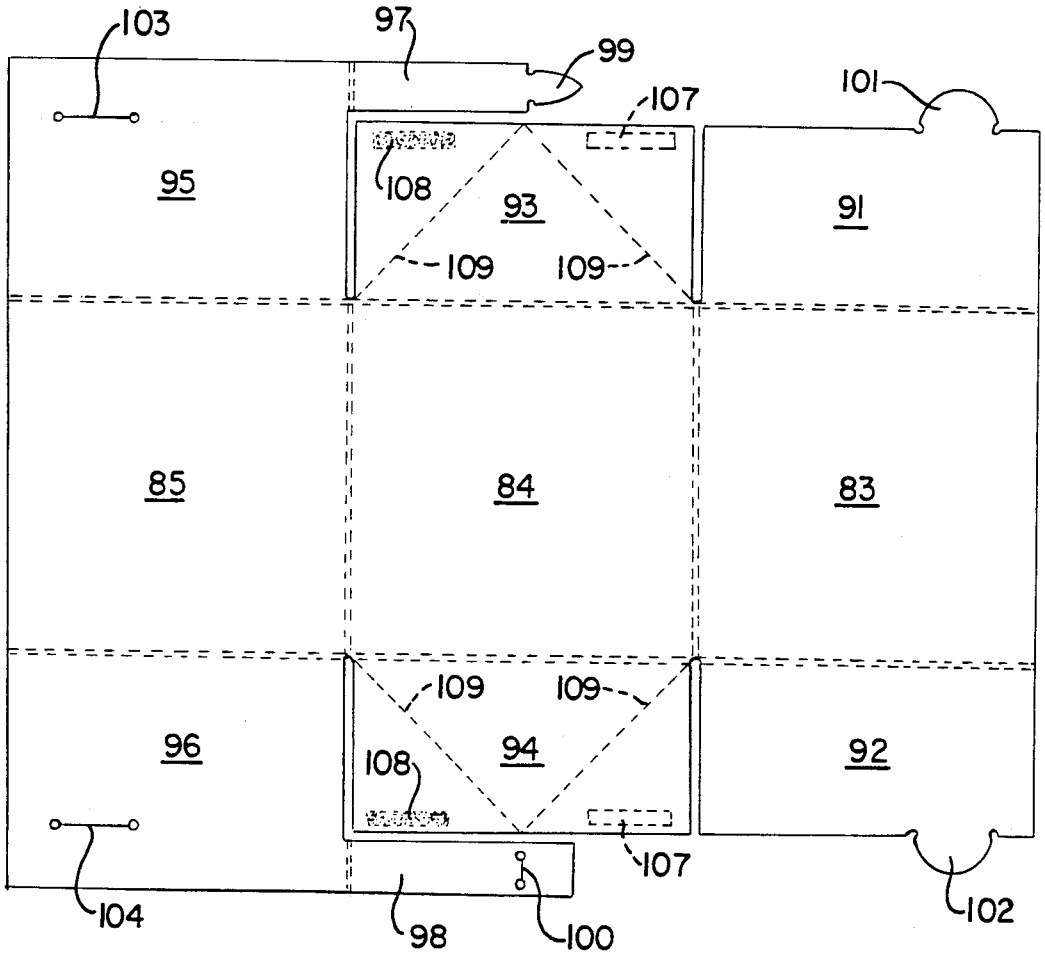
FIG. 13 is a plan of a paperboard blank which when folded forms the body of a two-piece gift wrap box of my invention.

The body portion blank of FIG. 13 comprises a body side panel 83, a bottom panel 84, and a second body side panel 85. Panels 83, 84 and 85 have end extensions 91, 93 and 95 respectively on one side of the blank and end extensions 92, 94 and 96 respectively on the other side of the blank. Extensions 91, 92, 93 and 94 have a dimension crosswise of the blank half of their respective panels 83 and 84. All extensions are separated from their adjoining extensions. Panel 85 has end extensions 95 and 96 respectively each having a dimension crosswise of the blank greater than half of their panel 85. Panel extensions 95 and 96 have tongues 97 and 98 respectively on their edges adjoining panel extensions 93 and 94 respectively extending more than halfway across said panel extensions 93 and 94. Tongue 97 has a reduced width tip 99 and tongue 98 has a transverse slot 100 positioned halfway across panel 94 which slot accepts tip 99 when my box is folded, as has been described hereinbefore. The extensions 91 and 92 of panel 83 at each end have tabs 101 and 102 respectively projecting from their outer edges and the extensions 95 and 96 of panel 85 each have slots 103 and 104 respectively positioned to accept tabs 101 and 102 respectively when my box is folded, as will be described hereinafter.

Figure 15:
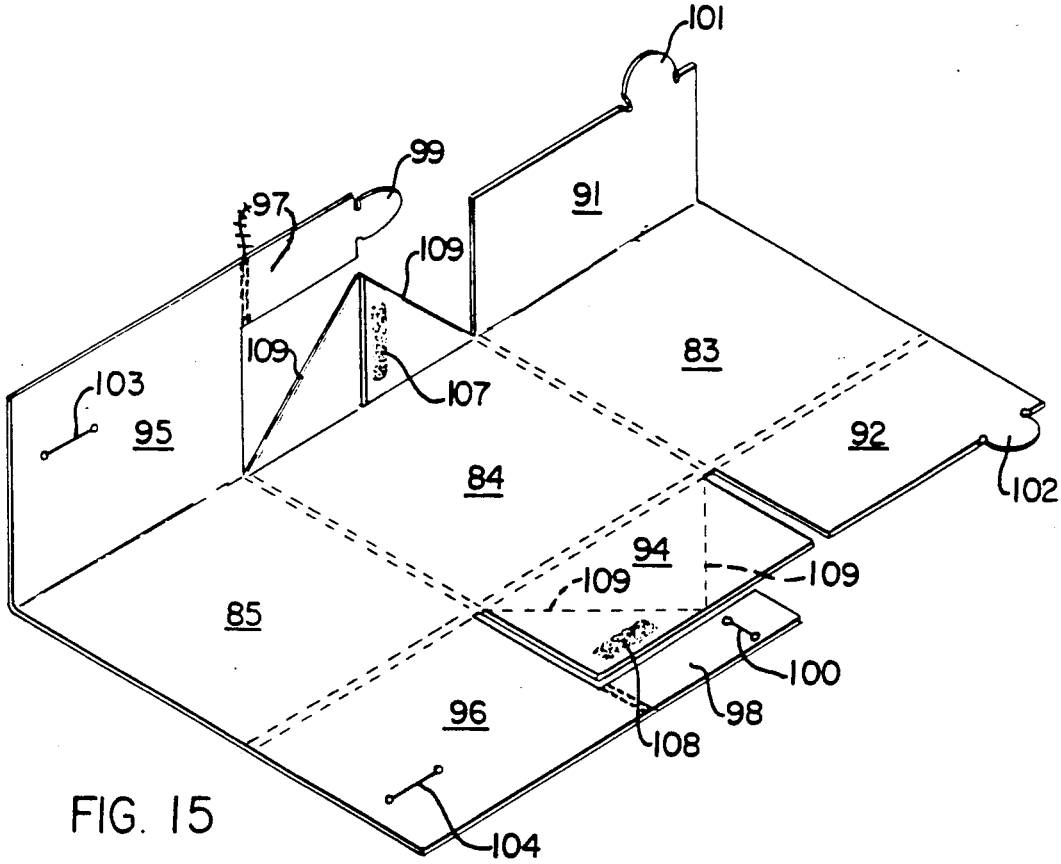
FIG. 15 is an isometric of the body portion of the box of FIG. 13 partially folded.

My body portion above described is assembled by folding and gluing. As may be seen in FIG. 15, the junctions in my panels 83, 84 and 85 with each other and with their respective extensions are creased, and diagonal lines 109 on extensions 93 and 94, are creased. The outer corners of extensions 93 and 94 are folded over 180 degrees along diagonal lines 109. Glue areas 108 on those corners are adhered to the underlying portions of end extensions 93 and 94 respectively. The side panel extensions 91, 92, 95 and 96 are folded upwardly 90 degrees along their junction with their respective side panels 83 and 85. Side panel 83 is folded upwardly 90 degrees at its junction with bottom panel 84 and folded-over corners of panels 93 and 94 are glued to their adjoining side panel extensions at areas 107. Tongues 97 and 98 are folded inwardly at their junction with extensions 95 and 96 so as to lie on bottom panel 84 and tongue tip 99 is inserted in slot 100 so that the tongues form a stiffener as has been described hereinbefore. Side panel 85 is folded upwardly 90 degrees around its junction with bottom panel 84 and tabs 101 and 102 are inserted in slots 103 and 104 respectively. The assembled body portion of my box is shown in FIG. 17.

Figure 14:
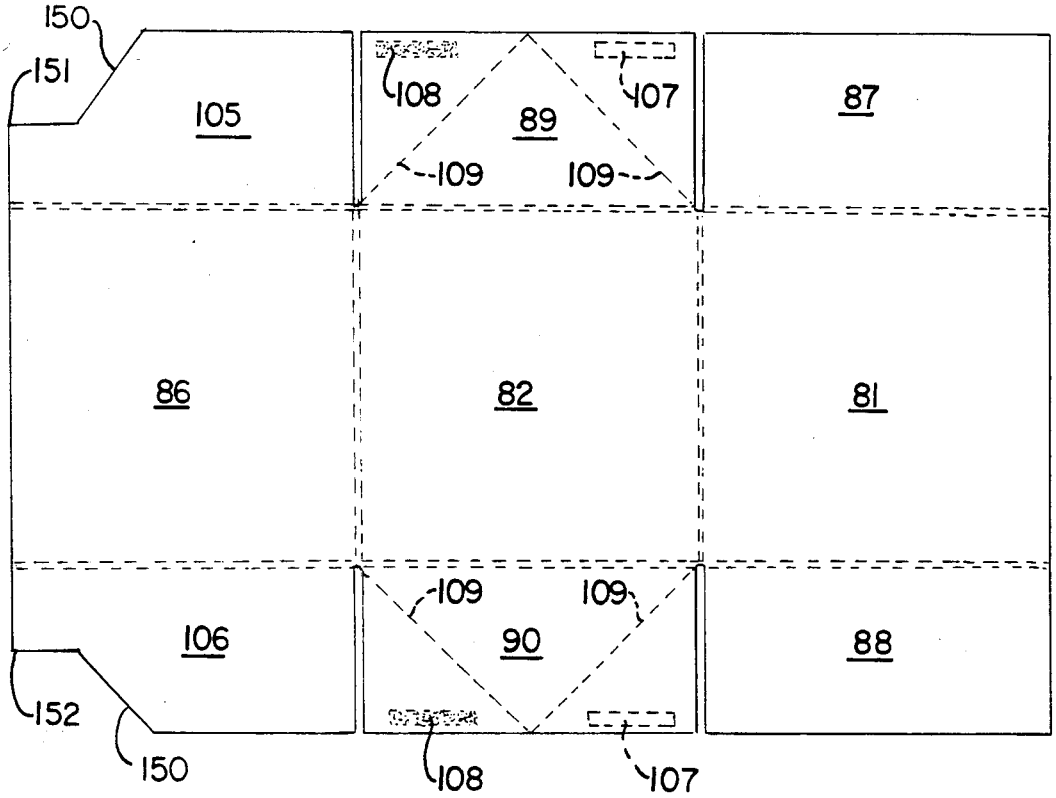
FIG. 14 is a plan of a paperboard blank which when folded forms the cover of a two-piece gift wrap box of my invention.
Figure 16:
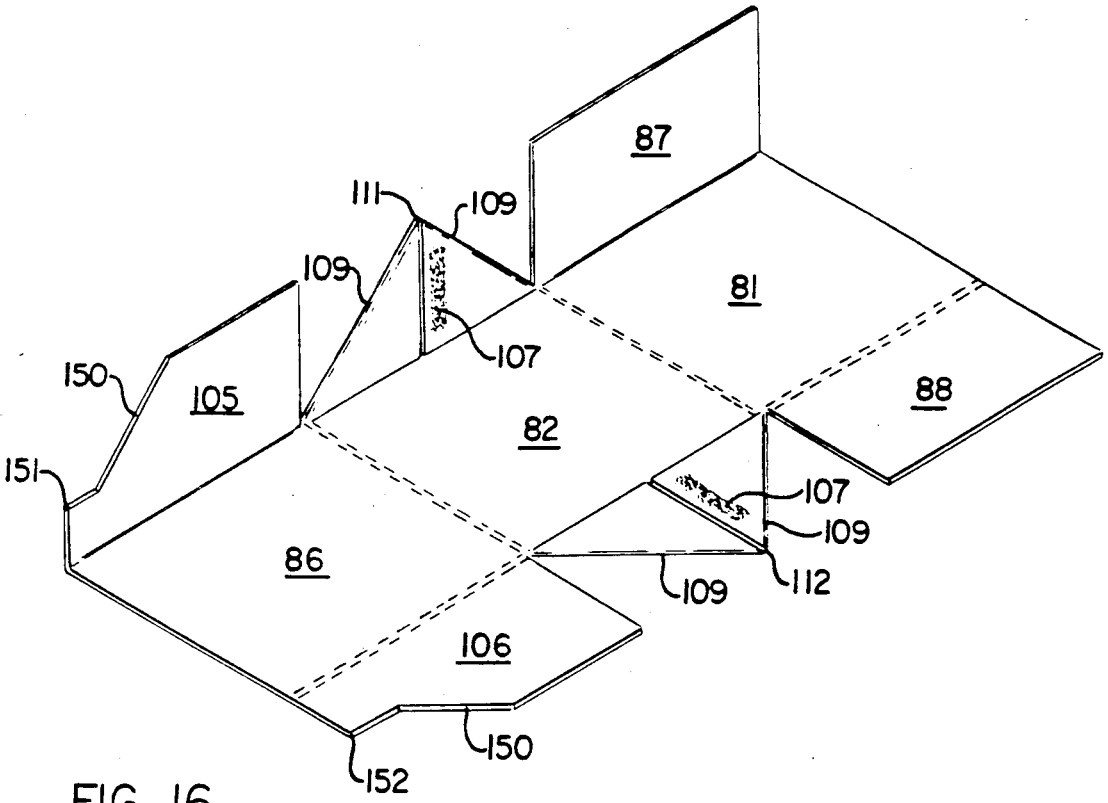
FIG. 16 is an isometric of the cover of FIG. 14 partially folded.

The cover portion blank of FIG. 14 comprises a cover side panel 81, a cover top panel 82 and a second side panel 86 attached thereto. The side and top panels 81, 82 and 86 have end extensions 87, 89 and 105 respectively at one end and 88, 90 and 106 respectively at the other end. The extensions extend half the longitudinal dimension of panel 82. All extensions are separated from their adjoining extensions. The outside corners of extension panels 105 and 106 are cut away diagonally at 150 so as to leave square corners 151 and 152 of less depth than the inside corners of the extension. The diagonal 150 has the same inclination as diagonals 109. The junctions of panels 81 and 82 and 86 with each other and with their respective extensions are creased, and diagonal lines 109 in end extensions 89 and 90 are creased. The cover portion is assembled by folding and gluing, shown in FIG. 16 in the same manner as my body portion previously described, the glue being applied at areas 107 and 108 of panels 89 and 90 as is shown in FIG. 14. The outer corners of top extensions 89 and 90 are folded over 180 degrees along diagonal lines 109. Side and top panel extensions 87, 88, 89, 90, 105 and 106 are folded 90 degrees along their junction with their respective side and top panels. Side panel 81 and top panel 82 are then folded 90 degrees at their junction and adjoining areas are glued together, with fold-over panels 89 and 90 on the outside. The assembled cover portion of my box is shown in FIG. 17 in position to be assembled with the body portion of my box.

Figure 17:
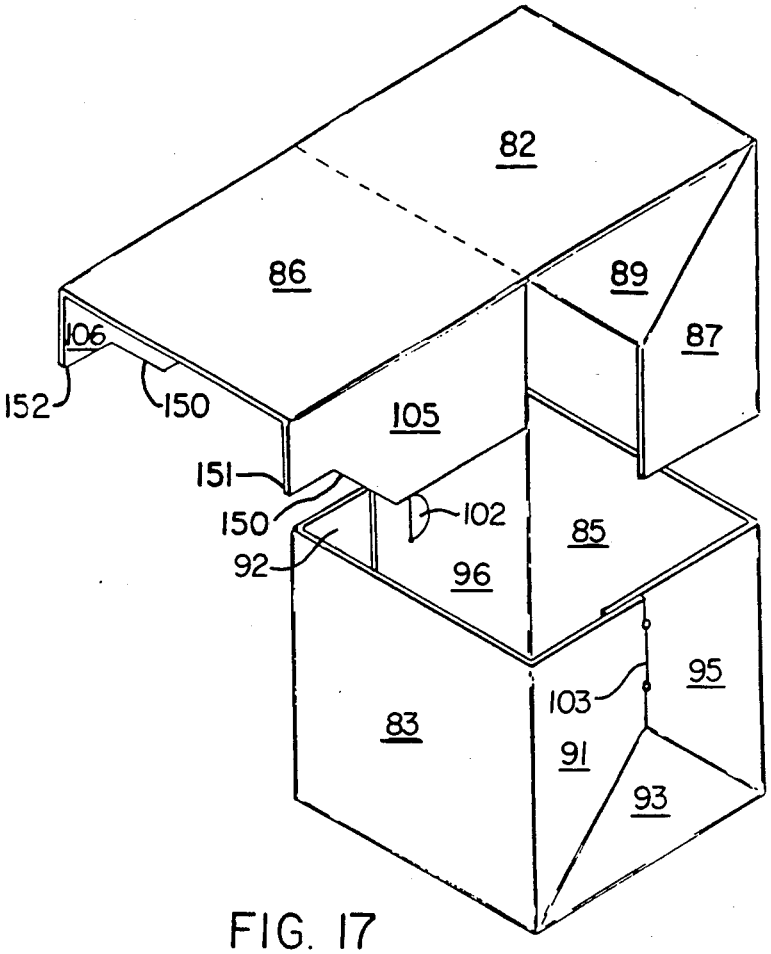
FIG. 17 is an isometric of the body and cover of FIGS. 15 and 16 positioned for assembly.

My box is put together by moving cover and body assemblies toward each other vertically, as indicated in FIG. 17. The outside corners of side panel extensions 87 and 88 slide in between turned-over panels 95 and 93 of one end of the body portion and 96 and 94 of the other end of my body portion. Those elements of the body portion are not glued together.

Figure 18:
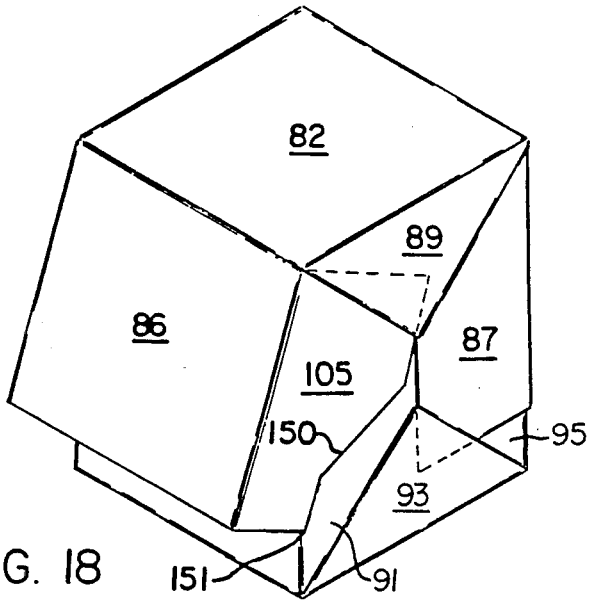
FIG. 18 is an isometric of the body and cover of FIGS. 15 and 16 partially assembled.

Panel 86 is then folded toward panel 82 bringing the upper corners of side panels 105 and 106 inside triangular cover panels 89 and 90 respectively. As the angle between panels 82 and 86 approaches 90 degrees the lower corners 151 and 152 of panels 105 and 106 are inserted between body panel extensions 93 and 91 on one side and 94 and 92 on the other side as is indicated in FIG. 18. Diagonals 150 parallel the diagonal 109 of the body portion but the diagonal edges of panels 105 and 106 are cut to extend below the diagonal folded edges 109 of body triangular panels 94 and 93, and the lower or outside corners 151 and 152 of panels 105 and 106 form tuck tabs which hold the cover in place on the bottom. The completely closed box duplicates in appearance the one-piece box of FIG. 6 previously described.

Figure 20:
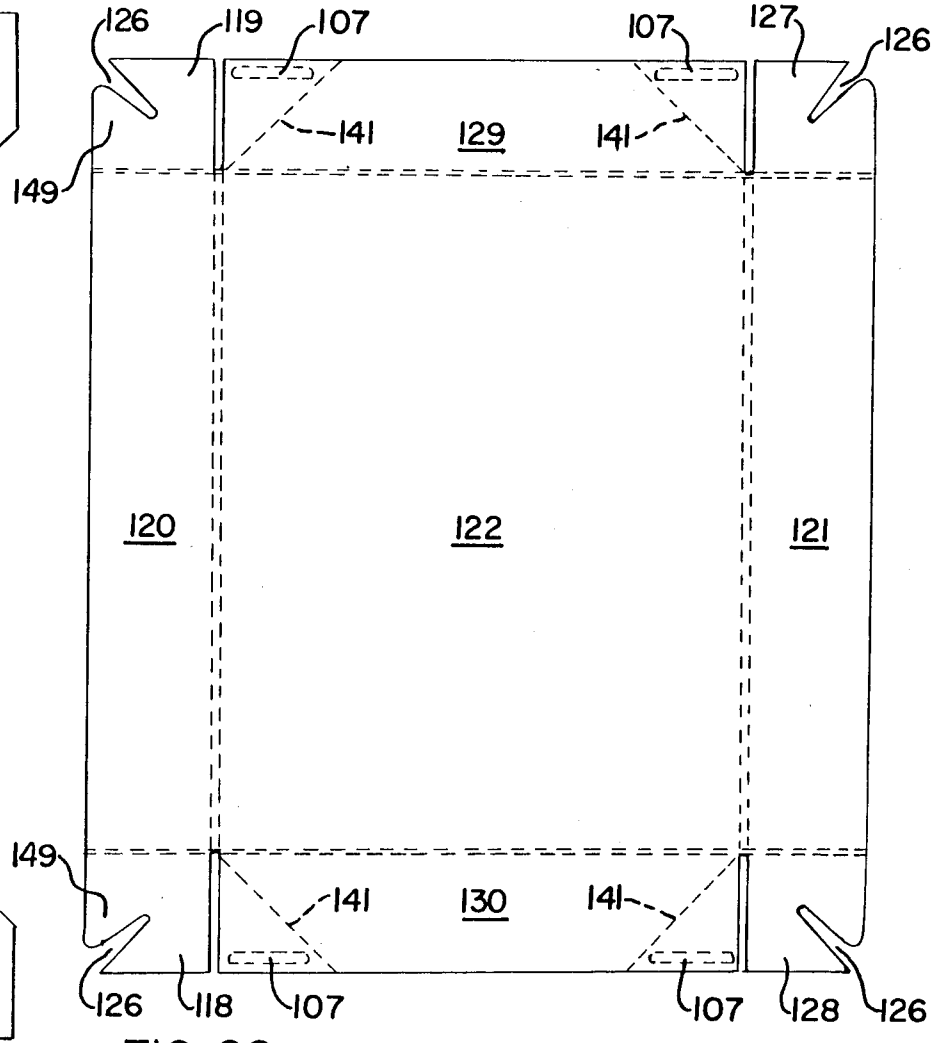
FIG. 20 is a plan of a paperboard blank which when folded forms the cover of a second embodiment of the two-piece gift box of my invention.
Figure 19:
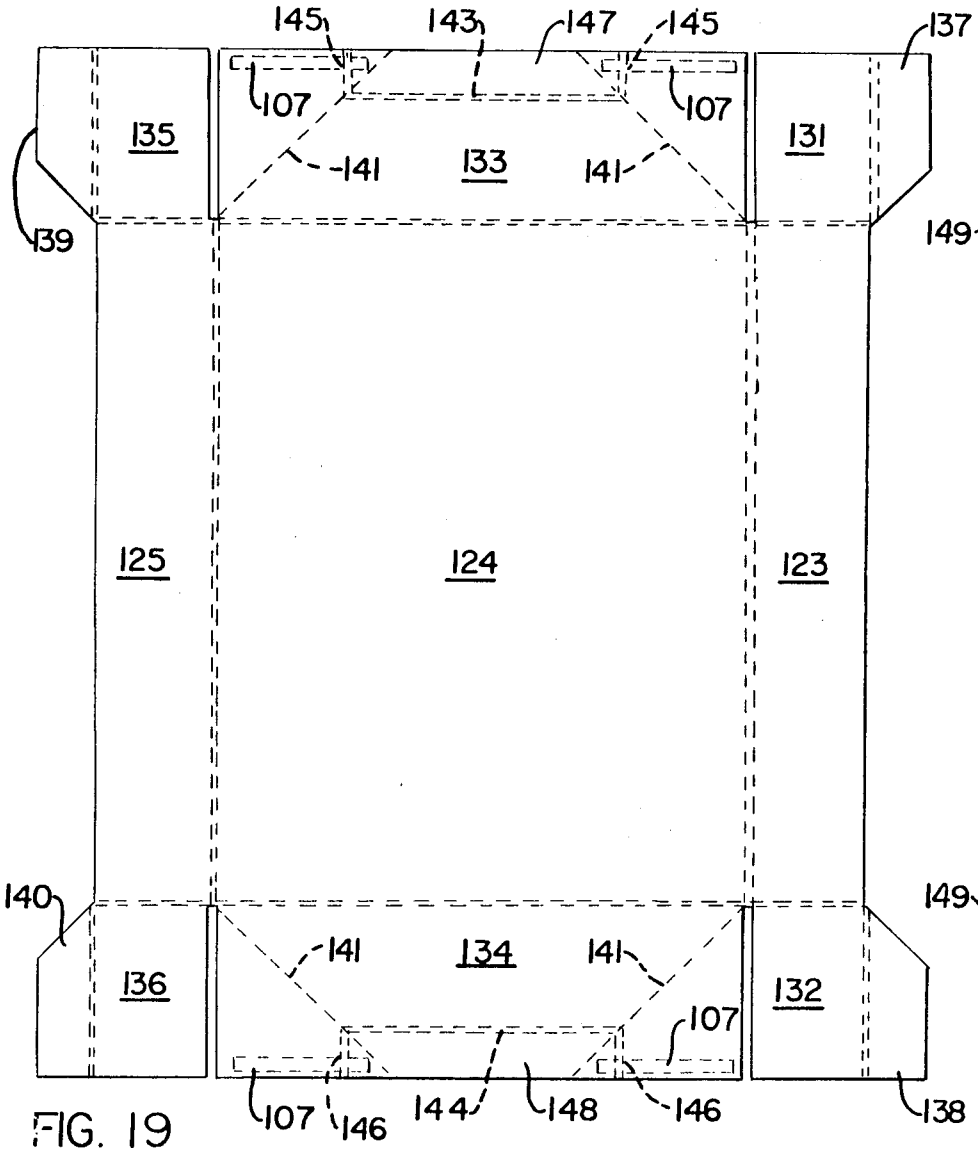
FIG. 19 is a plan of a paperboard blank which when folded forms the body of a second embodiment of the two-piece gift box of my invention.

A second embodiment of my invention is suitable for relatively flat boxes. FIG. 20 shows the box cover blank comprising cover side panel 121, top panel 122, and side panel 120. FIG. 19 shows the box body blank, comprising body side panel 123, bottom panel 124 and body side panel 125. Panel 121 has extensions 127 and 128 respectively at each end, each extension having a diagonal slot 126 running from its outside corner about halfway along its diagonal. Panel 122 has end extensions 129 and 130. Panel 120 has end extensions 118 and 119. Panel 123 has end extensions 131 and 132 formed with tabs 137 and 138 respectively on their side edges. Bottom panel 124 has end extensions 133 and 134 respectively and body side panel 125 has end extensions 135 and 136 with tabs 139 and 140 corresponding to extensions 131 and 132 previously described. All extensions are separated from their adjoining extensions. Extensions 131, 132, 133, 134, 135 and 136 are of the same length and extend beyond extensions 118, 119, 127, 128, 129 and 130, which are all of the same length. Extensions 129, 130, 133 and 134 are creased diagonally along lines 141 from their inside corners. Extensions 133 and 134 are also creased parallel to their bottom panel boundaries on lines 143 and 144 respectively, spaced from the adjoining edges of bottom panel 124 a distance equal to that of the outer edge of extension panels 129 and 130 from the adjoining edges of top panel 122, plus allowance for folding. Creased lines 143 and 144 are the same length except for their folding allowance as the outer edges of extension panels 129 and 130 between their scored diagonal lines 141 and are bounded at each end by scored diagonal lines 141 previously mentioned. Lines 145 are creased normal to the outer edge of extension panel 133 from the ends of creased lines 143, and lines 146 are likewise creased normal to the outer edge of extension panel 134 from the ends of creased line 144.

Figures 21, 22:
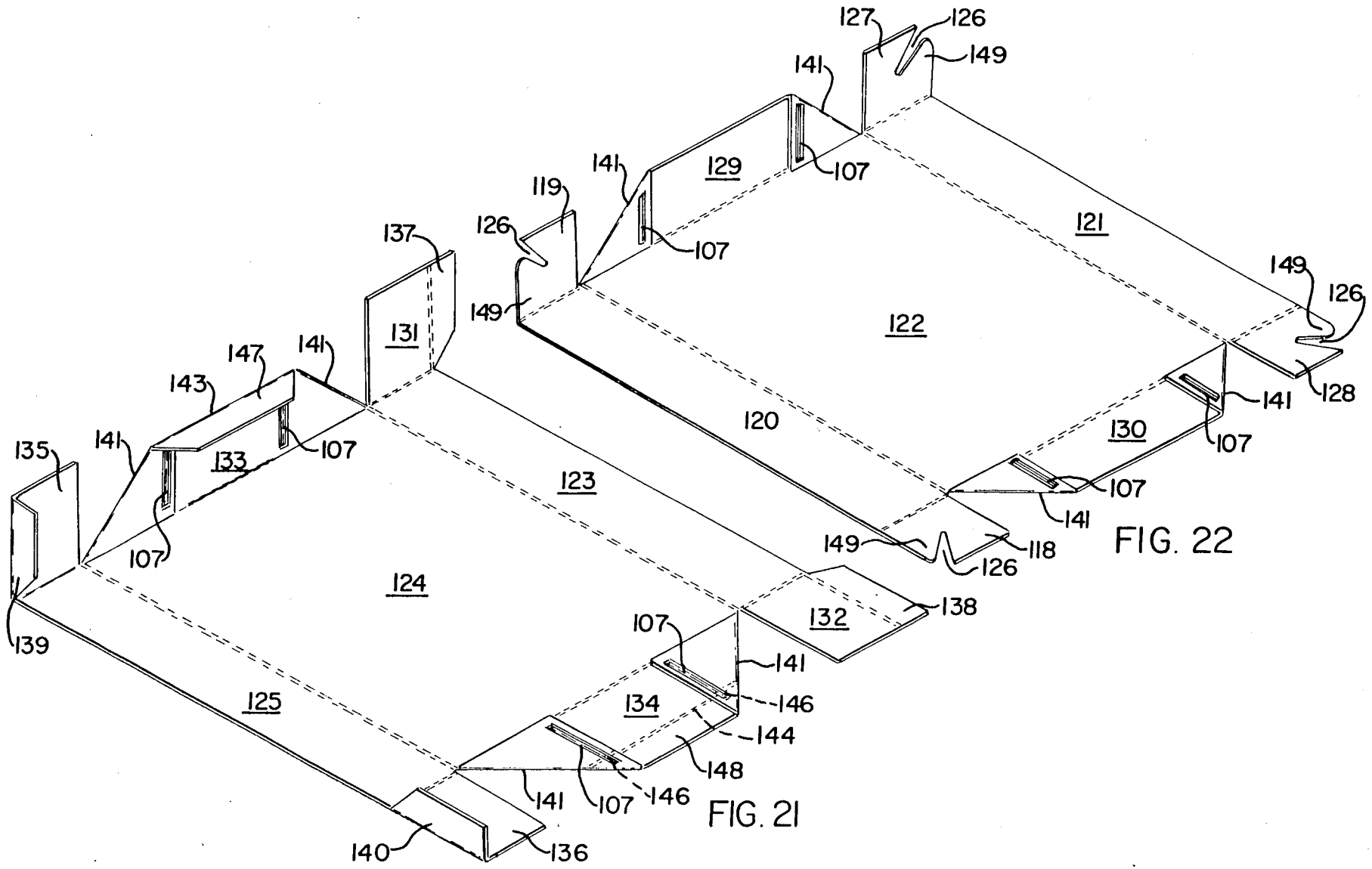
FIG. 21 is an isometric of the partially folded blank of FIG. 19.
FIG. 22 is an isometric of the partially folded blank of FIG. 20.

In erecting my box, the outer corners of extension panels 129, 130, 133 and 134 are folded 180 degrees inwardly along creased diagonal lines 141 as is shown in FIGS. 21 and 22. That folding of panels 133 and 134 aligns creased line 145 with creased line 143 and creased line 146 with creased line 144 so as to form flaps 147 and 148 respectively extending from creased lines 143 and 144. Panel extensions 119, 127, 129, 131, 133 and 135 are folded 90 degrees inwardly about their common boundary with panels 120, 121, 122, 123, 124 and 125 respectively. Tabs 139 and 140 are folded 90 degrees about their boundaries with panel extensions 135 and 136 respectively. Flap 147 is folded 90 degrees inwardly about creased line 143.

Figure 23:
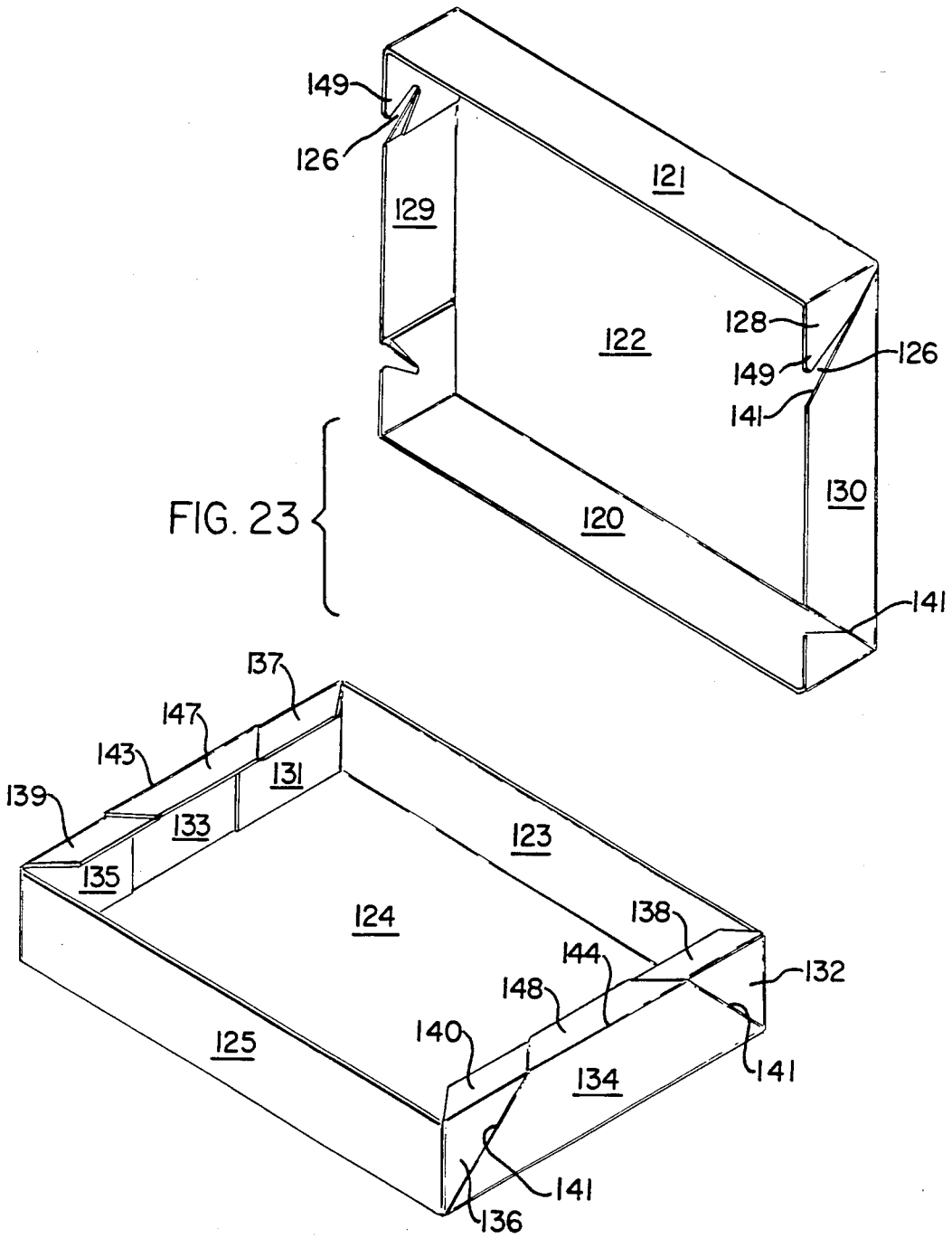
FIG. 23 is an isometric of the blanks of FIGS. 19 and 20 completely folded into body and cover respectively of the two-piece gift box of my invention.

Panel extensions 118, 128, 130, 132, 134 and 136 are folded upwardly 90 degrees. Cover side panel 121 together with extensions 127 and 128 is folded upwardly along its edge common to top panel 122. Body side panel 123 is folded upwardly 90 degrees along its edge common to bottom panel 124, bringing panel extensions 131 and 132 and their tabs with it. Flap 148 is folded inwardly 90 degrees around line 144. Extensions 131 and 132 of side panel 123 are folded inside panels 133 and 134 respectively and their tabs 137 and 138 are folded 90 degrees inwardly beneath flaps 147 and 148 respectively. Body side panel 125 is folded 90 degrees upwardly about its edge common to panel 124 and its extensions 135 and 136 are likewise folded inside panels 133 and 134 respectively and their tabs 139 and 140 are folded inwardly beneath tabs 147 and 148. In this way an open box body is formed, as is shown in FIG. 23.

My box cover is formed by folding side panels 120 and 121 90 degrees inwardly about their edges common to top panel 122. When the cover is placed on the body, top panel extensions 129 and 130, now folded into isosceles trapezoids, come down outside bottom panel extensions 133 and 134 respectively. Panel extensions 118, 119, 127 and 128 are slotted as mentioned so as to form tuck tabs 149. Slots 126 are co-extensive throughout their lengths with the diagonals 141 of adjoining end extensions 129 and 130 when the latter are folded as shown in FIG. 23, and tuck tabs 149 are inserted under the trapezoidal bottom panel extensions 133 and 134 but over body side panel folded extensions 131, 132, 135 and 136 respectively in the same way that tuck tabs 79 are inserted between panels 66 and 64 in FIG. 11, thus locking the box in the configuration shown in FIG. 12. The overlapping trapezoidal end extensions on the end shown, and on the other end not shown, give my box the appearance of a handwrapped package.

It is not essential that end extensions 130 and 134 overlap completely. When my box is cut to form only a partial overlap of those panels, its end appearance is still like that of a hand-wrapped package.

In the following claims I use the term "isosceles figures" to designate isosceles triangles and isosceles trapezoids only.

In the foregoing specification I have described presently preferred embodiments of my invention; however, it will be understood that my invention can be otherwise embodied within the scope of the following claims.

I claim:

1. A simulated gift wrap box having an open top body and cover of paperboard and the like, the body having a unitary bottom and two unitary oppositely disposed side panels only with extensions at each end of said bottom and said side panels respectively hinged thereto and folded against each other, the cover having a unitary top and at least one unitary side panel with extensions at each end of said top and said side panel respectively hinged thereto and folded against each other, the top panel and bottom panel extensions having their outer corners folded inwardly against them respectively on diagonal lines to form isosceles figures, the extensions of said at least one cover side panel overlapping said body side panel extensions and underlapping said body isosceles figures.

2. The gift-wrap box of claim 1 in which the isosceles figures are isosceles triangles.

3. The gift-wrap box of claim 2 in which the extensions of the body side panels overlap at the apexes of the body triangles.

4. The gift-wrap box of claim 2 in which the extensions of the body side panels are formed with tongue and slot interlocking means.

5. The gift-wrap box of claim 2 in which the body ends are square.

6. The gift-wrap box of claim 2 in which said body triangles and cover triangles meet at their apexes.

7. The gift-wrap box of claim 1 in which the isosceles figures are isosceles trapezoids.

8. The gift-wrap box of claim 7 in which all diagonal folds are substantially at an angle of 45 degrees.

9. The gift-wrap box of claim 7 in which the depths of the cover member and body member isosceles trapezoids are equal.

10. The gift-wrap box of claim 7 in which the body isosceles trapezoids terminate in a flap which is adapted to be folded inwardly over the inwardly folded extensions of its sides.

11. The gift-wrap box of claim 10 in which the extensions of the body side panels have flaps on their upper edges which fold under the folded flaps of the bottom panel extensions.

12. The gift-wrap box of claim 1 in which the cover side panel extensions have diagonal slots extending from their corners forming tuck tabs which interlock with the diagonal folds of its body isosceles figures.

13. The gift-wrap box of claim 1 in which said cover and said body are hinged together.

14. The gift-wrap box of claim 1 in which said cover and said body are separate members.

15. The gift-wrap box of claim 14 in which said cover includes two side panels.

16. The gift-wrap box of claim 1 in which the body and cover end extensions are separated extensions.

17. The gift-wrap box of claim 16 in which the outer corners of the body and cover end extensions are free corners.

* * * * *